United States Patent [19]

Pfeifer

[11] Patent Number: 4,775,125

[45] Date of Patent: Oct. 4, 1988

[54] VARIABLE RETAINER FOR A SHELF SUPPORT

[75] Inventor: William Pfeifer, Springdale, Pa.

[73] Assignee: Armstrong Store Fixture Corporation, Pittsburgh, Pa.

[21] Appl. No.: 32,423

[22] Filed: Mar. 30, 1987

[51] Int. Cl.[4] ..... F16L 3/08

[52] U.S. Cl. ..... 248/222.1; 108/108; 211/192; 211/193; 248/243

[58] Field of Search ..... 248/243, 222.1; 108/108, 110, 148; 211/192, 193, 190; 411/393, 903, 908

[56] References Cited

U.S. PATENT DOCUMENTS

| | | | |
|---|---|---|---|
| 2,060,760 | 11/1936 | Keil | 248/222.1 X |
| 3,400,831 | 9/1968 | De Niet | 211/193 |
| 3,501,993 | 3/1970 | Swenson | 411/393 |
| 3,572,626 | 3/1971 | Bertschi | 248/243 |
| 4,531,698 | 7/1985 | Sharber | 248/243 |

FOREIGN PATENT DOCUMENTS

| | | | |
|---|---|---|---|
| 2640423 | 3/1977 | Fed. Rep. of Germany | 248/222.1 |
| 983392 | 2/1965 | United Kingdom | 248/222.1 |

*Primary Examiner*—David L. Talbott

*Attorney, Agent, or Firm*—Parmelee, Miller, Welsh & Kratz

[57] ABSTRACT

A retainer for securing a shelf support to a wall. The retainer comprises a base having a first side for facing a wall and an oppositely facing second side. First and second spaced, generally parallel projections, extend generally perpendicularly outwardly from the second side of the base. A recess-engaging section extends generally perpendicularly outwardly from the second side of the base, between and generally parallel to the projections, and is adapted to be received within a recess in an end of a shelf support when the end of the shelf support is received between the projections. Means are disposed on the base for variably spacing the retainer from a wall. When the shelf support is disposed between the projections of the retainer, and the wall engaging means of the shelf support is inserted within a groove in the planar surface of the wall and engages a vertical member disposed within the wall, the projections inhibit lateral movement of the shelf support. Further, the means for variably spacing spaces the retainer from the wall to an extent sufficient for the wall engaging means to tightly engage the vertical member to secure the shelf support to the wall.

10 Claims, 1 Drawing Sheet

VARIABLE RETAINER FOR A SHELF SUPPORT

BACKGROUND OF THE INVENTION

The invention relates to a retainer for securing a shelf support to a wall. More particularly, the invention relates to such a retainer for locking a shelf support within vertical grooves in a wall containing a vertical member to which the shelf support is secured.

Various methods have been used to lock a shelf support to a vertical member contained within slots in a wall to prevent both vertical and lateral movement of the shelf support with respect to the wall. If the shelf support is not sufficiently secured to the wall, it can become loose and fall out of the slot in the wall, thus causing the shelf resting on the self support and the contents of the shelf to fall.

U.S. Pat. Nos. 745,873 to Mancha, 813,501 to Keil and 1,760,503 to Knape disclose shelf support brackets which include upper and lower hook members to secure the shelf support within slots in a vertical member disposed along a wall. In addition, threaded screws or bolts, disposed through a recess in the shelf support bracket between the hook members, and through a corresponding slot in the vertical member help to secure the shelf support to the vertical member. The degree to which the screws are turned within the recess and slot affects how tightly the hook members engage the portions of the vertical members between the slots. Mancha and Knape further include bracing members to lend additional lateral support to the shelf support.

U.S. Pat. Nos. 4,534,529 and 4,589,172 to Dorner describe a shelf bracket and cooperable locking bracket retainer. The retainer, in part, includes two plates and a wedge-shaped element extending between the plates. The wedge-shaped element of the retainer includes a locking surface which is complementary to a beveled locking edge of a recess in the shelf bracket. Thus, the wedge-shaped element is designed to be received within the recess in the shelf bracket so that the shelf bracket is wedged between the two plates of the retainer. In use, a pair of L-shaped members, located above and below the recess in the shelf bracket, are inserted within slots in a wall so that the plates and wedge-shaped element on the retainer abut the outer surface of the wall. The retainer is tapped from above to effect the wedging action. It should be noted that the retainer is only useful with a shelf bracket having a recess with a beveled locking edge that is complementary to the design of the locking surface of the wedge-shaped element of the retainer.

Further, I disclose in my copending U.S. Pat. application Ser. No. 032,424, entitled "Retainer for a Shelf Support Bracket", filed Mar. 30, 1987 a retainer for securing a shelf support to a wall that is useful with a variety of shelf support and wall designs. The retainer comprises first and second spaced, generally parallel and coextensive planar members. The planar members are complementary in shape, having opposed inner surfaces, and outer surface with raised sections. An integral connecting segment extends between the inner surfaces of the planar members. When the connecting segment is disposed within a recess in an end of a shelf support the inner surfaces of the planar members abut the horizontally elongated flat surfaces of the shelf support. When the connecting segment of the retainer is disposed within the shelf support recess, and the wall engaging means of the shelf support is inserted within a groove in the planar surface of a wall and engages a vertical member disposed within the wall, at least a portion of the planar members of the retainer are wedged within the groove, and the raised sections of the outer surfaces of the planar members abut the surface of the wall on both sides of the groove to inhibit lateral movement of the shelf support within the groove.

It is desired to develop a retainer for a shelf support that can be used with a variety of shelf support configurations and a variety of wall designs.

SUMMARY OF THE INVENTION

The invention is a retainer for securing a shelf support to a wall. The wall has a planar surface with at least one groove therein for access to vertical members disposed within the wall. The shelf support has a pair of oppositely exposed, horizontally elongated flat surfaces. One end of the shelf support includes a recess, and wall engaging means for entry into the grooves in the wall and engagement of the vertical member in the wall to secure the shelf support to the wall. The retainer comprises a base having a first side adapted to face the planar surface of the wall and an oppositely facing second side. First and second spaced, generally parallel projections extend generally perpendicularly outwardly from the second side of the base. The projections have opposed inner surfaces, and are adapted to receive the end of a shelf support therebetween so that the inner surfaces of the projections abut the elongated surfaces of the shelf support. A recess-engaging section extends generally perpendicularly outwardly from the base, between and generally parallel to the projections, and is adapted to be received within the recess in the end of the shelf support when the end of the shelf support is received between the projections. Means are disposed on the base for variably spacing the first side of the base of the retainer from the planar surface of the wall. When the shelf support is disposed between the projections of the retainer, and the wall engaging means of the shelf support is inserted within a groove in the planar surface of the wall and engages the vertical member, the projections of the retainer inhibit lateral movement of the shelf support within the groove. In addition, the means for variably spacing will space the first side of the base of the retainer from the planar surface of the wall to an extent sufficient for the wall engaging means to tightly engage the vertical member to secure the shelf support within the groove in the planar surface of the wall.

The retainer of the invention can be used with a variety of shelf support configurations, a variety of wall designs, and with walls having varying depths of the vertical members therein, by varying the distance between the planar surface of the wall and the wall facing side of the retainer.

BRIEF DESCRIPTION OF THE PREFERRED EMBODIMENTS

Figure 1:
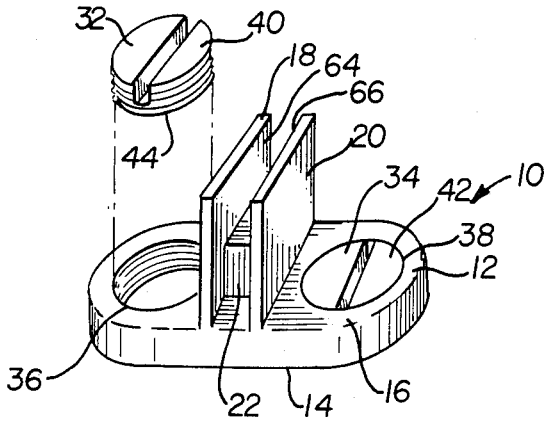
FIG. 1 is a perspective, partially exploded, view of a retainer formed in accordance with the invention.
Figure 2:
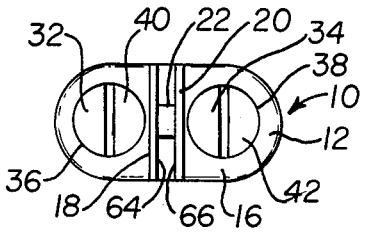
FIG. 2 is a plan view of the top of the retainer shown in FIG. 1.

The retainer 10 of the invention includes a base 12. The base 12 has a first, wall-facing, side 14 and an oppositely facing second side 16.

First and second spaced, generally parallel projections 18 and 20, respectively, extend generally perpendicularly outwardly from the second side 16 of the base 12. A recess-engaging section 22 extends generally perpendicularly outwardly from the second side 16 of the base 12 and extends between and generally parallel to the projections 18 and 20. The recess-engaging section 22 of the retainer 10 is adapted to coact with a recess 24 in an end 26 of a shelf support 28 to improve the stability of the attachment of the shelf support 28 to a wall 30.

Variable spacing means, preferably first and second variable spacing means 32 and 34, respectively, are disposed on the base 12, one variable spacing means on eiher side of the projections 18 and 20. The spacing means 32 and 34 are adapted to space the first side 14 of the base 12 of the retainer 10 from a wall 30. The first and second variable spacing means are adjustable so that the distance between the first side 14 of the base 12 of the retainer 10 and the wall 30 is variable. As shown in the Figures, preferably the base 12 includes first and second tapped bores 36 and 38, respectively, and the variable spacing means 32 and 34 are first and second threaded screws or bolts 40 and 42, respectively, which are threadedly engaged within the bores 36 and 38, respectively. The lower ends 44 of the screws 40 and 42 preferably have a flat, non-marring surface so that the lower ends 44 of the screws 40 and 42 do not damage the planar surface 46 of the wall 30 when the screws 40 and 42 are turned within the bores 36 and 38 so that the lower ends 44 of the screws 40 and 42 abut the wall 30 and space the retainer 10 from the planar surface 46 of the wall 30. The extent to which the screws 40 and 42 are turned within the bores 36 and 38 determines how far the retainer 10 is spaced from the planar surface 46 of the wall 30.

Figure 4:
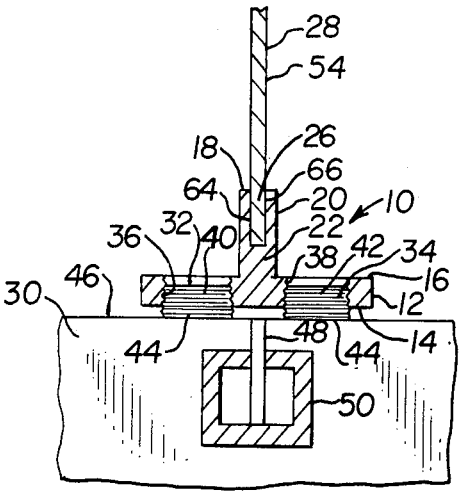
FIG. 4 is a sectional view of the retainer shown in FIG. 1 in place within a recess in an end of a shelf support that is secured to a wall taken along the line IV—IV of FIG. 3.
Figure 3:
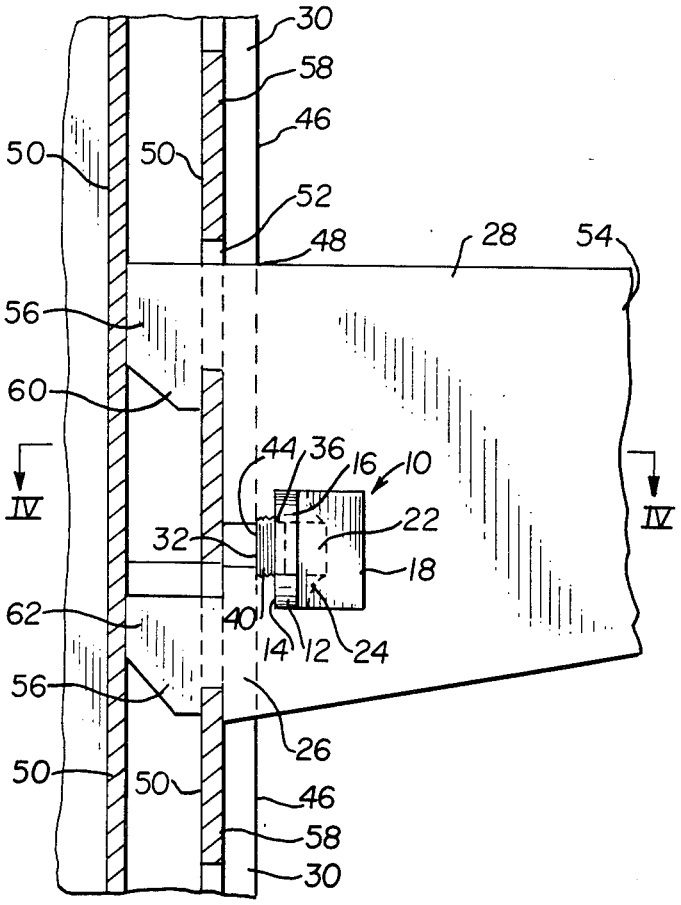
FIG. 3 is a sectional view of the retainer shown in FIG. 1 in place within a recess in an end of a shelf support that is secured to a wall.

As shown in FIGS. 3 and 4, the retainer 10 of the invention can be used to secure a shelf support 28 to a wall 30. The surface 46 of the wall 30 has at least one, preferably vertical, groove 48 therein for access to a plurality of vertical members 50 disposed within the wall 30. The vertical members 50 are preferably elongated metal strips having a plurality of slots 52 therein. The vertical members 50 are disposed within the wall 30 so that the slots 52 are aligned with the grooves 48 in the planar surface 46 of the wall 30. Suitable shelf supports 28 for use in connection with the retainer 10 of the invention includes those which have a pair of oppositely exposed, horizontally elongated, flat surfaces 54. One end 26 of the shelf support 28 includes a recess 24 and wall engaging means 56. The recess 24 can be of any shape, but is generally a T-shape. The wall engaging means 56 is adapted for entry within a groove 48 in the planar surface 46 of the wall 30 and for engagement of sections 58 of the vertical member 50 between the slots 52. The wall engaging means 56 includes upper and lower hook members 60 and 62, respectively, which engage sections 58 between the slots 52 in the vertical member 50 disposed behind the planar surface 46 of the wall 30 when the end 26 of the shelf support 28 is placed within a groove 48 in the planar surface 46 of the wall 30.

In order for a retainer 10 of the invention to be used to help to secure a shelf support 28 to a wall 30, the shelf support 28 is disposed between the projections 18 and 20 so that the inner surfaces 64 and 66, respectively, of the projections 18 and 20 abut the elongaged surfaces 54 of the shelf support 28 and the recess-engaging section 22 of the retainer 10 is disposed within the recess 24 in the end 26 of the shelf support 28.

Once the shelf support 28 is secured between the projections 18 and 20, the end 26 of the shelf support 28 is placed within the desired groove 48 in the planar surface 46 of the wall 30 so that the hook members 60 and 62 engage the sections 58 between the slots 52 in the vertical member 50. The screws 40 and 42 are turned within the bores 36 and 38, respectively, until the lower ends 44 of the screws 40 and 42 abut the planar surface 46 of the wall 30 and space the wall-facing side 14 of the retainer 10 from the planar surface 46 of the wall 30 an extent sufficient for the hook members 60 and 62 of the shelf support 28 to tightly engage the section 58 of the vertical member 50 between the slots 52 in the vertical member 50 to secure the shelf support 28 within the groove 48 in the planar surface 46 of the wall 30. The projections 18 and 20 of the retainer 10 inhibit lateral movement of the shelf support 28 within the groove 48 in the planar surface 46 of the wall 30.

The retainer 10 can be formed of any suitable materials such as metal or a plastic. Preferably, the base 12, the projections 18 and 20 and the recess-engaging section 22 of the retainer 10 are formed of metal or plastic, and the screws 32 and 34 are plastic.

The retainer 10 of the invention can be used with shelf supports 28 having a variety of shapes and depths of recesses 24. The usefulness of the recess-engaging section 10 does not depend upon the recess-engaging section 22 being a shape that is exactly complementary to that of the recess 24 in the end 26 of the shelf support 28. As long as the recess-engaging section 22 is generally as long and as wide as the length and the width, respectively, of the recess 24, the recess-engaging section 22 will prevent vertical and lateral movement, respectively, of the retainer 10 with respect to the shelf support 28. Thus, the recess-engaging section 22 of the retainer 10 need not be as deep as the recess 24. Further, the retainer 10 of the invention can be used with walls 30 having varying depths of the vertical members 50 therein. The degree to which the variable spacing means 32 and 34 separates the retainer 10 from the wall 30 can be adjusted to compensate for differences in the depth of the vertical members 50 within various walls 30 by varying the degree to which the screws 40 and 42 are turned within the bores 36 and 38 of the retainer 10.

What is claimed is:

1. A retainer for securing a shelf support to a wall, said wall having a planar surface with at least one groove therein for access to a vertical member disposed within said wall, and said shelf support having a pair of oppositely exposed, horizontally elongated, flat surfaces, one end of said shelf support including a recess, and wall engaging means for entry into a said groove in said planar surface of said wall and engagement of said vertical member in said wall to secure said shelf support to said wall, said retainer comprising:

a base having a first side adapted to face said planar surface of said wall and an oppositely facing second side;

first and second spaced, generally parallel projections extending generally perpendicularly outwardly from said second side of said base, said projections having opposed inner surfaces, and being adapted to receive said end of said shelf support therebetween so that said inner surfaces of said projections abut said elongated surfaces of said shelf support;

a recess-engaging section extending generally perpendicularly outwardly from said base, extending between and generally parallel to said projections, and adapted to be received within said recess in said end of said shelf support when said end of said shelf support is received between said projections; and means, disposed on said base, for variably spacing said first side of said base of said retainer from said planar surface of said wall;

such that when said shelf support is disposed between said projections of said retainer, and said wall engaging means of said shelf support is inserted within said groove in said planar surface of said wall and engages said vertical member, said projections of said retainer inhibit lateral movement of said shelf support within said groove, and said means for variably spacing will space said first side of said base of said retainer from said planar surface of said wall to an extent sufficient for said wall engaging means to tightly engage said vertical member to secure said shelf support within said groove in said planar surface of said wall.

2. The retainer of claim 1 wherein said base includes first and second tapped bores, disposed one on either side of said projections, and said variably spacing means are threaded screws disposed within said bores, said screws having a bottom surface adapted to abut said planar surface of said wall as said screws are turned within said bores to space said base of said retainer from said planar surface of said wall.

3. The retainer of claim 2 wherein said threaded screws have lower ends which have a flat and non-marring surface.

4. The retainer of claim 2 wherein said base is metal and said threaded screws are plastic.

5. The retainer of claim 2 wherein said base and said threaded screws are plastic.

6. In combination:

a wall having a planar surface with at least one groove therein for access to a vertical member disposed within said wall;

a shelf support having a pair of oppositely exposed, horizontally elongated, flat surfaces, one end of said shelf support including a recess, and wall engaging means for entry into a said groove in said planar surface of said wall and engagement of said vertical member in said wall; and a base having a frist side adapted to face said planar surface of said wall and an oppositely facing second side;

first and second spaced, generally parallel projections extending generally perpendicularly outwardly from said second side of said base, said projections having opposed inner surfaces, and being adapted to receive said end of said shelf support therebetween so that said inner surfaces of said projections abut said elongated surfaces of said shelf support;

a recess-engaging section extending generally perpendicularly outwardly from said base, extending between and generally parallel to said projections, and adapted to be received within said recess in said end of said shelf support when said end of said shelf support is received between said projections; and means, disposed on said base, for variably spacing said first side and said base of said retainer from said planar surface of said wall;

such that when said shelf support is disposed between said projections of said retainer, and said wall engaging means of said shelf support is inserted within said groove in said planar surface of said wall and engages said vertical member, said projections of said retainer inhibit lateral movement of said shelf support within said groove, and said means for variably spacing will space said first side of said base of said retainer from said planar surface of said wall to an extent sufficient for said wall engaging means to tightly engage said vertical member to secure said shelf support within said groove in said planar surface of said wall.

7. The retainer of claim 6 wherein said base includes first and second tapped bores, disposed one on either side of said projections, and said variably spacing means are threaded screws disposed within said bores, said screws having a bottom surface adapted to abut said planar surface of said wall as said screws are turned within said bores to space said base of said retainer from said planar surface of said wall.

8. The retainer of claim 7 wherein said threaded screws have lower ends which have a flat and non-marring surface.

9. The retainer of claim 7 wherein said base is metal and said threaded screws are plastic.

10. The retainer of claim 7 wherein said base and said threaded screws are plastic.

* * * * *